US006986728B2

(12) United States Patent
Kasun

(10) Patent No.: US 6,986,728 B2
(45) Date of Patent: Jan. 17, 2006

(54) WRIST, HAND AND FINGER EXERCISE DEVICE METHOD OF USE AND METHOD OF MANUFACTURE

(76) Inventor: Mark Kasun, 1730 Spear St., South Burlington, VT (US) 05403

( * ) Notice: Subject to any disclaimer, the term of this patent is extended or adjusted under 35 U.S.C. 154(b) by 469 days.

(21) Appl. No.: 10/317,899

(22) Filed: Dec. 12, 2002

(65) Prior Publication Data

US 2003/0087729 A1 May 8, 2003

Related U.S. Application Data

(63) Continuation-in-part of application No. 09/998,951, filed on Nov. 15, 2001, now abandoned.

(60) Provisional application No. 60/253,072, filed on Nov. 24, 2000.

(51) Int. Cl.
*A63B 23/16* (2006.01)

(52) U.S. Cl. ..... 482/44; 482/48

(58) Field of Classification Search ..... 482/44–50, 482/121, 124, 132, 148; 446/48; D21/684
See application file for complete search history.

(56) References Cited

U.S. PATENT DOCUMENTS

| | | | | |
|---|---|---|---|---|
| 3,612,521 | A * | 10/1971 | Wendeborn | 482/48 |
| 5,062,625 | A * | 11/1991 | Vonk | 482/48 |
| 6,179,751 | B1 * | 1/2001 | Clears | 482/48 |
| 6,817,967 | B1 * | 11/2004 | Ott et al. | 482/48 |

* cited by examiner

*Primary Examiner*—Stephen R. Crow
(74) *Attorney, Agent, or Firm*—Eric R. Benson

(57) ABSTRACT

A new, novel and useful wrist, hand and finger exercise device method of use and method of manufacture. The wrist, hand and finger exercise device is manufactured to facilitate the method of exercising and concomitant strengthening of the wrist, hand and fingers while engaged in the activity for which the exercise is directed. The method of manufacture permits the manufacture of exercise devices of widely varied resistance using the same stock material according to user defined parameters. This invention allows the user to exercise during the activity with minimal restriction or interference from the device itself. This method of use is particularly beneficial in strengthening the wrist, hand and fingers for users engaged in various dextrous activities, such as: typing; playing of instruments; surgery; arts of coiffure; fine art; and mechanical work, etc.

11 Claims, 2 Drawing Sheets

WRIST, HAND AND FINGER EXERCISE DEVICE METHOD OF USE AND METHOD OF MANUFACTURE

CROSS REFERENCE TO RELATED APPLICATION

This Application is a Continuation-In-Part of the Co-Pending patent application U.S. Ser. No. 09/998,951—filed Nov. 15, 2001 (Claiming Priority from Provisional Patent Application No. 60/253,072—filed Nov. 24, 2000)

BACKGROUND OF THE INVENTION

Field of the Invention

The present invention relates to new and useful improvements in wrist, hand, and finger exercise devices, methods of use and methods of manufacture, which include those designed for use by musicians while playing a preferred instrument. Wrist, hand and/or finger exercise devices are well known in the art. Reference can be made to any of the U.S. Pat. Nos. 248,980 to Atkins, U.S. Pat. No. 272,941 to Gardner, U.S. Pat. No. 1,174,205 to Underwood, U.S. Pat. No. 1,256,004 to Finney, U.S. Pat. No. 1,472,906 to Gorrell, U.S. Pat. No. 1,743,264 to Breza, U.S. Pat. No. 1,796,216 to Pettersson, U.S. Pat. No. 3,606,316 to Krewer, U.S. Pat. No. 3,612,521 to Wendeborn, U.S. Pat. No. 3,724,314 to Columbo, U.S. Pat. No. 3,944,220 to Fasano, U.S. Pat. No. 4,657,243 to Thomas, U.S. Pat. No. 4,765,608 to Bonasera, U.S. Pat. No. 4,828,249 to Keating, U.S. Pat. No. 4,964,630 to Curtis, U.S. Pat. No. 5,062,625 to Vonk, U.S. Pat. No. 5,366,436 to Gibney, U.S. Pat. No. 5,445,582 to Brown, U.S. Pat. No. 5,538,488 to Villepique, U.S. Pat. No. 5,549,520 to Grahm, and U.S. Pat. No. 5,613,923 as representative prior art.

The prior art reveals a few wrist, hand, and/or finger exercise devices and methods of use which have been developed that are specifically designed for use by musicians. U.S. Pat. No. 1,472,906 to Gorrell illustrates and describes an enclosed box-like unit comprising elastic bands for exercising the digits of a musicians' hand. U.S. Pat. No. 1,743,264 to Breza discloses and claims a device composing a curve shaped metal spring to be used by musicians for exercising the digits of the hand. Neither are designed specifically for use while playing a musical instrument or otherwise engaged in an activity for which the exercise would be directed.

Some devices enable the user to exercise the wrist, hand, and/or fingers while playing a particular instrument or are otherwise engaged in an activity for which the exercise would be directed. These devices are typically cumbersome and impractical for casual use. They are also not applicable for use with different types of instruments or the handling of items for which an exercise would be directed. U.S. Pat. Nos. 248,980, 272,951, and 4,765,608 present illustrations of such devices. Each of these devices when properly fitted is harnessed to the user's wrist. All three devices consist of a wrist harness to which the main body of the device is secured. The main body extends toward the tips of the user's fingers over the back of the hand. From here the unit is attached to the appropriate fingers of the hand by means of various component loops. All three devices essentially provide the user with the ability to exercise the wrist, hand, and/or fingers while playing an instrument or are otherwise engaged in an activity for which the exercise would be directed.

U.S. Pat. Nos. 248,980 and 272,951, are devices wherein the best mode of practice is designed for use while playing keyboard instruments. U.S. Pat. No. 4,765,608, is a device wherein the best mode of practice is applicable to stringed instruments such as a guitar. All three devices are similarly inconvenient and difficult to assemble, to put on, to use, and to wear. They are also subject to frequent adjustments before and during use.

Other devices and methods of use provide alternative means for exercising the wrist, hand and/or fingers but are not specifically designed for use by musicians, nor are these devices specifically designed to be used while playing a musical instrument or are otherwise engaged in an activity for which the exercise would be directed.

U.S. Pat. No. 3,612,521, illustrates a physical therapy device comprised of a series of joined elastic loops which when properly fitted encircle the base of the user's four fingers including the thumb. The device provides the user with the means for exercising the fingers and hand while performing common tasks. Although it is effective for physical therapy purposes the inclusion of the thumb harness and response member render it obstructive for use while playing a musical instrument or other activities requiring the palm area of the hand to be free of obstructions. For example the majority of musical instruments, surgical devices and tools, etc. need to be cradled in the hand while in use. The response member stretches from the thumb to the pinkie across the palm. It would obstruct the hand and fingers from gaining access to the item being grasped or manipulated in the hand. Furthermore, the thumb harness would prevent the thumb from resting in proper playing position in the playing of many musical instruments.

It is a primary object and advantage of the methods now presented to be a more practical, effective and user friendly means of providing high impact training for a user's wrists, hands and fingers. Once applied onto the hand the user engages in the desired activity such as playing their instrument as they would normally. The device is designed to fit both right and left hand similarly. The user may wear the device on either a single or both hands where applicable, such as a pianist or classical guitarist which use fingers on both hands to play their instruments or a typist that would ordinarily type with both hands. It is not necessary to create a specifically right or left hand oriented device. Its manner of use is uncomplicated wherein it is simple to apply and use. No adjustment is necessary before, during or after use to obtain greater results from the device. The device in its fully manufactured form will be compact in size and lightweight. Wherein said, it shall be easily carried in a clothing pocket, travel bag or musical instrument carrying case.

While applied to the users' hand the outer joints and fingers of the hand are neither shackled or encumbered by the device. The harnessed fingers will maintain full natural muscular movement without obstruction of the proper form of the hand and when placed into a position for a desired activity, such as the playing of an instrument or working with tools, or typing, etc. In one method of using the device it is designed to encircle only the four fingers while leaving the thumb un-harnessed. This allows the thumb freedom to be in proper position for playing an instrument or other activities that require the freedom of the thumb. The non-obstructive design of said method of using the device makes possible practical application for its intended use to a variety of musical instruments which require repetitive individual or simultaneous movement of the fingers in order to properly operate. This method of using the device is versatile. It can be used while playing numerous instruments. It is an easy method to use and effective for playing string and keyboard instruments as it is for woodwind and valve instruments. The user is not limited to specific movements. The method allows the user to perform scales on a keyboard or brass instrument as easily as chord shapes on a stringed instrument.

In another method of using this device it is designed to encircle all the fingers of the hand including the thumb. In activities where the hands and fingers form and move in generally one plane the thumb may be contained by the device including its musculature in the exercise activity, such as typing.

The device will be manufactured to suit various hand sizes, such as providing the user with a choice of small, medium or large fitting. The resistance that the device poses shall also be manipulatable. Each size could be produced with several degrees of resistance of the elastic material used. For instance a low, medium and high resistance available in each sizing. There by, offering the user a selection of devices which suit the specific size and strength of a hand.

Consistent use of the method of using the exercise device will promote progressive strengthening of the wrist, hand and fingers. As the user gains strength they may advance from a low resistance to an increased resistance method. When used correctly and consistently the device will accelerate strength, speed and dexterity in the users' execution of intended movements of the hand and fingers. The method of use provides the user with the means for a higher impact workout of the wrist, hand and fingers, and may reduce the average length of practice sessions of musicians for instance. Furthermore, it is a fast and effective warm-up method for performers.

In yet another method of use the wrists, hands and fingers of one or more hands of a user are linked together in a glove-like embodiment of the device. This method is very effective in exercising the entire wrist, hand and finger as an integral unit for tasks which often require handling objects firmly and carefully with strength and dexterity as in surgical procedures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting in any way the scope of this invention or claims which will be made in a full patent application to follow.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions and methods insofar as they do not depart from the spirit and scope of the present invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the present invention to provide a wrist, hand and finger exercise devise method of use and method of manufacture which has many of the advantages of the wrist, hand and finger exercise devises, methods of use and methods of manufacture mentioned heretofore and many novel features that result in a wrist, hand and finger exercise devise method of use and method of manufacture which is not anticipated, rendered obvious, suggested, or even implied by any of the prior art wrist, hand and finger exercise devise, methods of use and methods of manufacture, either alone or in any combination thereof.

It is another object of the present invention to provide a new and novel wrist, hand and finger exercise devise method of use and method of manufacture which may be easily and efficiently manufactured, taught and marketed.

It is a further object of the present invention to provide a new and novel wrist, hand and finger exercise devise method of use and method of manufacture which is of a durable and reliable construction and method.

An even further object of the present invention is to provide a new and novel wrist, hand and finger exercise devise method of use and method of manufacture which is susceptible of a low cost of manufacture with regard to both materials and labor, and which accordingly is then susceptible of low prices of sale to the consuming public, thereby making such wrist, hand and finger exercise devise, methods of use and methods of manufacture economically available to the buying public.

Still yet another object of the present invention is to provide a new and novel wrist, hand and finger exercise devise, methods of use and methods of manufacture which provides in the apparatuses and methods of the prior art some of the advantages thereof, while simultaneously overcoming some of the disadvantages normally associated therewith.

These together with other objects of the invention, along with the various features of novelty which characterize the invention, will be pointed out with particularity in the claims once the full application is filed. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other that those set forth above will become apparent when consideration is given to the following detailed description thereof. Such description makes reference to the annexed drawings wherein.

Figure 1:
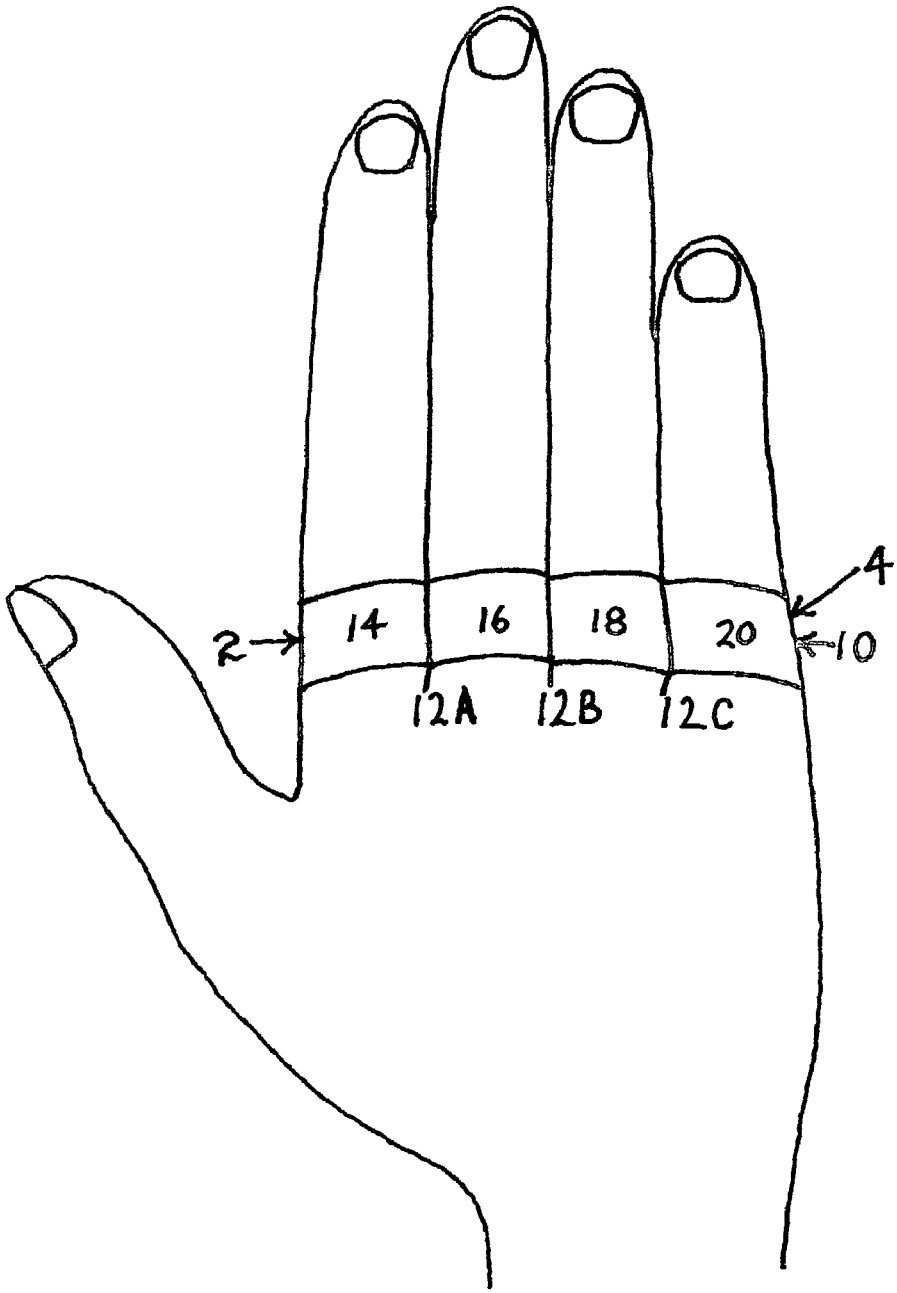
FIG. 1. is a perspective top view of the proper harnessing to the users' hand of individual connected elastomeric finger loops encircling the four fingers and excluding the thumb. The users' fingers and hand are relaxed and the elastomeric finger loops are retracted.
Figure 2:
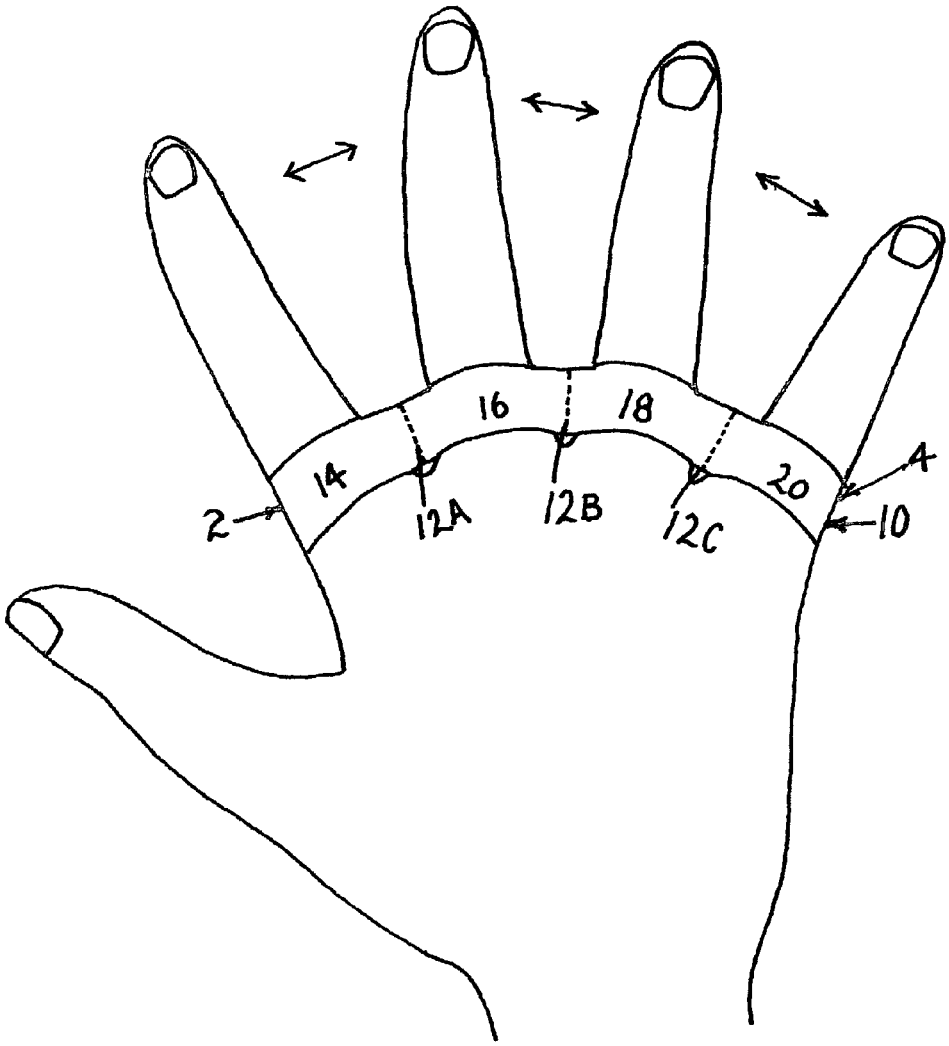
FIG. 2. is a perspective top view of the straining lengthwise of the elastomeric finger loops by spreading the fingers apart to achieve the desired exercise results.

In the preferred embodiment for use with musical instruments as depicted in FIGS. 1 and 2, the elastomeric finger loops are generally designated by the numeral 10 and are characteristically a one piece unit composed of elastic properties and segmented into four consecutive, closed finger loops. In another embodiment of the elastomeric finger loops 10 the closed fingers loops may be comprised of individual loops removably or permanently attached together to form the functioning device. The individual closed finger loops of the elastomeric finger loops 10 reading from left to right in FIGS. 1 and 2 are designated the numerals 14, 16, 18 and 20, and are defined by three partitions denoted as the numerals 12A, 12B, 12C and which are situated at predetermined intervals between the two closed outer ends of the device 10 denoted as the numerals 2 and 4.

The elastomeric finger loops 10 are typically a one piece unit comprising four closed finger loops 14, 16, 18, 20. The elastomeric finger loops 10 are composed and dependent of an elastic substance and maintains a retracted state when not in use as depicted in FIG. 1. When properly used the elastomeric properties of the elastomeric finger loops 10 provide resistance against the movement of the fingers and hand. When the hand is activated to engage in a desired activity, such as the playing of an instrument, the elastomer is forced to stretch with the fingers' movement. The elastomeric finger loops 10 become effective as an exercise unit as it resists the action of the hand and fingers when they are activated to perform a contemplated movement.

The user applies the elastomeric finger loops 10 by placing the correct fingers of a selected hand through the four closed finger loops 14, 16, 18, 20. The elastomeric finger loops' 10 natural form is to be at-rest in a retracted state, (as shown in FIG. 1). With the elastomeric finger loops 10 are properly harnessed and with the hand and fingers relaxed, the fingers are closed and slightly pulled together from the tension of the retracted elastomeric finger loops 10.

The elastomeric finger loops 10 work as a restraint of the fingers' movement. When the elastomeric finger loops 10 are properly fastened on a selected hand the user moves his or her fingers as they would normally to engage in an activity such as the playing of an instrument. Any separation of the fingers will force the elastomeric finger loops 10 to expand from its at-rest state and in turn the elastomeric finger loops 10 will resist the action. The elastomeric finger loops 10 become effective as an exercise unit when the at-rest state of the elastomeric finger loops 10 resists the exertion of the activated hand. A user of this method which is exercising the wrist, hand and fingers for playing a musical instrument may freely perform musical scales on a keyboard or brass instrument as easily as chord shapes on a stringed instrument fretboard and is not limited to specific movements as consequence to using the elastomeric finger loops 10.

When properly harnessed the elastomeric finger loops 10 will comfortably yet retentively seat at the base portions of only the four fingers, between the first and second joints, of the hand. The four closed finger loops 14, 16, 18, 20 will expand slightly to be applied onto the fingers then contract to conform to the fingers so to prevent the elastomeric finger loops 10 from slipping from the correct fitted position when in use. It is predetermined that the four closed finger loops 14, 16, 18, 20 dimensions shall negotiate the natural variance in the size of each finger of the hand. Accordingly, the closed finger loop 20 that fits upon the "pinkie" finger will be the smallest and the closed finger loop 14 that fits upon the "index" finger will be the largest.

It is the intended purpose and desired result of the device here-in-before described and below claimed to provide a practical, effective and non-obstructive means enabling a user, such as a musician to accelerate the speed, strength and dexterity of the wrist, hand and fingers while simultaneously allowing the user to engage in the desired activities for which the exercise is directed such as the ability to use the device while playing a wide variety of musical instruments.

The device will be partly or wholly made up of elastic materials depending on design preference or necessity of the inventor. In the preferred method of manufacture an elastomeric material is selected that provides user desired elastic resistance when stretched by the fingers of the hand and which resistance does not prevent a user from using the hand, wrist and fingers in an activity for which the use is directed at improving performance thereof by the exercise of performing the activity with the elastomeric finger loops 10 in place as depicted in FIG. 1. The elastomeric material is generally flat about one-half inch wide and about one sixteenth of an inch thick. A piece of the elastomeric material is cut such that it is long enough to extend around all four fingers of a user's hand when the fingers are juxtaposed as depicted in FIG. 1 with one end thereof overlapping the other end by about one quarter to one half inch. The overlapped portion is then stitched so that the elastomeric material forms an open loop that fits securely around the fingers of a hand held in the position depicted in FIG. 1. The resting state and load tension of the device is then created by stitching together with thread that has elastomeric properties in three places the opposite sides of the open loop which forms the four closed finger loops 14, 16, 18, 20 wherein the stitching comprises the three partitions denoted as the numerals 12A, 12B, 12C depicted in FIG. 2. This resting state tension and load tension can be further adjusted by adding stitching making the partitions 12A, 12B, 12C depicted in FIG. 2 wider which increases the resting state tension and load tension. Design material preference shall only be for the comfort and practicality of the user and will in no way affect the form, purpose or performance of the device.

In another embodiment of the method of manufacture pre-manufactured finger loops with user selected elastomeric properties are removably attached by an attachment means such that the pre-manufactured finger loops fit securely on a human hand as outlined in the preferred method of manufacture. The attachment means may be a snap, hook, clip or Velcro of sufficient holding capacity that will maintain the finger loops juxtaposed to one another as depicted in FIG. 1 and yet provide for the desired tension and resistance as between them as depicted in FIG. 2 with coming apart.

Those who are skilled in the art will readily perceive various modifications which fall within the spirit and scope of the invention. Therefore, the claims that will be filed with the full patent application are to be construed to cover all equivalent structures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention the exact construction and operation shown and described, and accordingly, all suitable modifications and equivalents may be resorted to, falling within the scope of the invention.

What is claimed as being new and novel and desired to be protected by Letters Patent of the united states is as follows:

1. A method of manufacturing a wrist, hand and finger exercise device comprising the steps of:

cutting a length of elastomeric material of user selected elasticity which is just long enough for one end of the length of elastomeric material to extend completely around the proximal phalanxes of the fingers of a human hand distal and adjacent to the heads of the second, third, fourth and fifth metacarpals when the fingers of the hand are extended straight and touching each other side by side in a common plane and overlap the other end of the elastomeric material;

attaching the end of the elastomeric material to the overlapped portion of the other end of the elastomeric material by use of an attachment means forming a loop thereby wherein the loop's elastic tension is sufficient to hold the loop in place around the proximal phalanxes of the fingers of the human hand distal and adjacent to the heads of the second, third, fourth and fifth metacarpals when the fingers of the hand are extended straight and touching each other side by side in a common plane;

collapsing the loop such that the elastomeric material forms a flattened loop with a top portion and a bottom portion juxtaposed to each other;

attaching the top portion and the bottom portion of the flattened loop in three locations by use of an attachment means such that when the flattened loop is un-collapsed the three attachments of the top portion and the bottom portion define four finger loops of a size capable of fitting on the proximal phalanxes of the fingers of the human hand distal and adjacent to the heads of the second, third, fourth and fifth metacarpals.

2. A method of using the manufactured wrist, hand and finger exercise device recited in claim 1 comprising the steps of:

selecting an activity for which exercise of the wrist, hand and fingers is desired;

harnessing the manufactured wrist, hand and finger exercise device to the proximal phalanxes of the fingers of one or both hands of the user depending upon the selected activity distal and adjacent to the heads of the second, third, fourth and fifth metacarpals by placing the fingers into the four finger loops;

engaging in the selected activity;

flexing the muscles of the wrist, hand and fingers through the full range of motion for the muscles while engaged in the selected activity such that the flexion is exaggerated and generally involves a motion that is natural for the selected activity;

extending the muscles of the wrist, hand and fingers through the full range of motion for the muscles while engaged in the selected activity such that the extension is exaggerated and generally involves a motion that is natural for the selected activity.

3. The method of using the manufactured wrist, hand and finger exercise device recited in claim 2 wherein the selected activity is the playing of a musical instrument.

4. The method of using the manufactured wrist, hand and finger exercise device recited in claim 2 wherein the selected activity is manual labor that involves use of the wrist, hand and fingers of one or both hands.

5. The method of using the manufactured wrist, hand and finger exercise device recited in claim 2 wherein the selected activity is typing.

6. The method of using the manufactured wrist, hand and finger exercise device recited in claim 2 wherein the selected activity is surgery.

7. The method of using the manufactured wrist, hand and finger exercise device recited in claim 2 wherein the selected activity is a sports activity that involves the use of the wrist, hand and fingers of one or both hands.

8. The method of using the manufactured wrist, hand and finger exercise device recited in claim 2 wherein the selected activity is hairdressing or barbery.

9. The method of manufacturing a wrist, hand and finger exercise device as recited in claim 1 wherein the attachment means is by stitching.

10. The method of manufacturing a wrist, hand and finger exercise device as recited in claim 1 wherein the attachment means is glue.

11. The method of manufacturing a wrist, hand and finger exercise device as recited in claim 1 wherein the attachment means is heat fusion.

* * * * *